US005088403A

United States Patent [19]

Shoji et al.

[11] Patent Number: 5,088,403

[45] Date of Patent: Feb. 18, 1992

[54] MARKER FOR CONFIRMATION OF PAPER WEB-THREADED PATHS AND PAPER WEB-THREADED PATH CONFIRMING APPARATUS FOR ROTARY PRESSES

[75] Inventors: Akihiro Shoji, Toyama; Noriyuki Shiba, Tokyo, both of Japan

[73] Assignee: Tokyo Kikai Seisakusho, Ltd., Tokyo, Japan

[21] Appl. No.: 627,456

[22] Filed: Dec. 14, 1990

Related U.S. Application Data

[63] Continuation-in-part of Ser. No. 397,927, Aug. 24, 1989, abandoned.

[30] Foreign Application Priority Data

Aug. 31, 1988 [JP] Japan ..... 63-215195

[51] Int. Cl.[5] ..... B41F 5/04; B41F 13/02; B41F 33/16

[52] U.S. Cl. ..... 101/227; 101/248

[58] Field of Search ..... 101/228, 181, 183, 248, 101/224, 227, 233, 234, 231, 179, 180; 226/91, 92, 10, 12, 28

[56] References Cited

U.S. PATENT DOCUMENTS 2,549,605 4/1951 Huck ..... 101/181
4,366,753 1/1983 Glanz ..... 101/181

OTHER PUBLICATIONS

"Newspaper Letterpress Presses", Research Institute 1970, pp. 126–138, ANPA Research Institute, N.Y., N.Y.

*Primary Examiner*—J. Reed Fisher
*Attorney, Agent, or Firm*—Armstrong, Nikaido, Marmelstein, Kubovcik & Murray

[57] ABSTRACT

A marker is used for the confirmation of the paper web-threaded paths for rotary presses. The marker includes a marking unit for putting a mark on a paper web and a regulator composed of 1) a timing detector to detect the rotational phase of a printing cylinder and transmit a detected timing signal and 2) a transmitter to transmit an operating signal to the marking unit when it receives a detected timing signal from the timing detector. The regulator control when a mark is put on the paper web by the marking unit so that the mark always has a predetermined phase with respect to the printed images produced during a printing operation. A paper web-threaded path confirming apparatus includes a mark detector to detect a mark put on the paper web by the marking unit and transmit a detected mark signal. A transmitter transmits a rotational phase signal relatively to the rotational phase of a cutter cylinder rotated in a folder unit. An examination unit examines whether or not the detected mark signal transmitting time is within a predetermined range of the rotational phase signal, when the detected mark signal and rotational phase signal are input thereinto. The marker and confirming apparatus enables the confirming of the paper web-threaded paths and the feeding of an erroneously threaded paper web into a proper path to be done before images have been printed actually thereon, and prevents a delay in starting a production printing operation.

4 Claims, 2 Drawing Sheets

MARKER FOR CONFIRMATION OF PAPER WEB-THREADED PATHS AND PAPER WEB-THREADED PATH CONFIRMING APPARATUS FOR ROTARY PRESSES

This application is a continuation-in-part of application Ser. No. 07/397,927 filed on Aug. 24, 1989, now abandoned.

BACKGROUND OF THE INVENTION

1. Field of the Invention

This invention relates to a marker which is used for the confirmation of the paper web-threaded paths and a paper web-threaded path confirming apparatus for rotary presses.

2. Description of the Prior Art

A rotary press, for example, a newspaper press, is generally operated so that a plurality of paper webs are sent to the same folder unit through paper web threading paths via different feeders and different press units. In order that the paper webs are cut at the folder unit with the printed images positioned properly on the paper webs according to various conditions including the number of pages of the final newspaper, the presence or absence of images to be colorprinted and the order of laminating the printed paper webs, it is necessary that the paper webs from the feeders be sent from the press units to the folder unit through predetermined paper web threading paths the lengths of which are set properly in the space between the press units and folder unit.

According to the conventional techniques of this kind, confirming that the paper webs fed have been threaded through correct paths is done by only examining whether or not the newspaper discharged from the folder unit is cut with the printed images on each page thereof positioned properly.

The confirming of the paths, through which the paper webs have been threaded, according to the conventional techniques cannot be done unless the paper webs are printed by the printer. For example, in an offset press, in which the printing of paper webs is not done during a paper web threading operation due to various restrictions including the restrictions on an operation of the offset press, the confirming of the paper web-threaded paths cannot be done before a production printing operation has been completed. If paper webs should be threaded through a wrong path, a lot of wrong-printed paper webs are wasted, and, moreover, a good deal of time is spent in carrying a paper web rethreading operation and a correction operation for suitably matching the paper web cutting position with the printed images thereon by changing the positions of the adjust rollers. This causes the printing operation to delayed greatly.

SUMMARY OF THE INVENTION

The marker which is used for the confirmation of the paper web-threaded paths for rotary presses according to the present invention consists of 1) a marking unit for putting a mark on a paper web and 2) a regulator composed of a) a timing detector adapted to detect the rotational phase of a printing cylinder and transmit a detected timing signal and b) an operating signal transmitter to transmit an operating signal to the marking unit when it receives a detected timing signal from the timing detector. The regulator controls when a mark is to be put on the paper web by the marking unit with a predetermined phase at all times with respect to the printed images produced during a printing operation.

The paper web-threaded path confirming apparatus for rotary presses according to the present invention has a marker which is used for the confirmation of the paper web-threaded paths, composed of 1) a marking unit for putting a mark on a paper web and 2) a regulator consisting of a) a timing detector to detect the rotational phase of a printing cylinder and transmit a detected timing signal and b) an operating signal transmitter to transmit an operating signal to the marking unit when it receives a detected timing signal from the timing detector. The regulator controls when a mark is to be put on a paper web by the marking unit with a predetermined phase at all times with respect to the printed images produced during a printing operation. The apparatus also includes in addition to the marker, 3) a mark detector to detect a mark put on a paper web by the marking unit and transmit a detected mark signal, 4) a transmitter to transmit a rotational phase signal based upon the rotational phase of a cutter cylinder rotated in a folder unit, and 5) an examination unit to examine whether or not the detected mark signal transmitting time is within a predetermined range of the rotational phase signal, when the detected mark signal from the mark detector and the rotational phase signal from the rotational phase signal transmitter are input thereinto.

When a paper web starts being fed, or when a paper web starts being moved through the path after a paper web threading operation has been completed, in a rotary press, the marker used for the confirmation of the paper web-threaded paths and the paper web-threaded path confirming apparatus are operated.

In the marker used for the confirmation of the paper web-threaded paths, the timing detector detects the rotational phase of the printing cylinder and transmits a detected timing signal to the operating signal transmitter. The operating signal transmitter sends out an operating signal to the marking unit when the detected timing signal from the timing detector has been input thereinto. The marking unit receives the operating signal and puts a mark on the paper web. Thus, the mark put on the paper web by the marking unit has a predetermined phase at all times with respect to a printed image produced during a printing operation.

The paper web on which a mark has been put in this manner is moved to the folder unit through a paper web-threading path, cut, folded and discharged.

The paper web thus discharged is examined visually as to whether or not the mark put thereon is in a predetermined position, whereby it is ascertained that this paper web was threaded through a predetermined path.

Where the paper web-threaded path confirming apparatus is also provided with this marker used for the confirmation of the paper web threaded paths, the marker is operated first in the same manner as mentioned above, and a mark is put on the paper web. The paper web on which marks are put at predetermined intervals is transferred through a predetermined path. The marks then reaches the mark detector and are detected, a detected mark signal being transmitted. On the other hand, the rotational phase signal transmitter is to transmit a rotational phase signal based upon the rotational phase of the cutter cylinder operated in the folder unit. When the examination unit receives a detected mark signal from the mark detector, and a rotational phase signal from the rotational phase signal transmitter, it examines whether or not the detected mark signal transmitting time is in a predetermined range of the rotational phase signal, i.e., whether or not the paper web is threaded through a predetermined path.

The objects as well as advantageous features of the invention will become apparent from the following description of the preferred embodiments taken in conjunction with the accompanying drawing.

DESCRIPTION OF THE PREFERRED EMBODIMENTS

Figure 1:
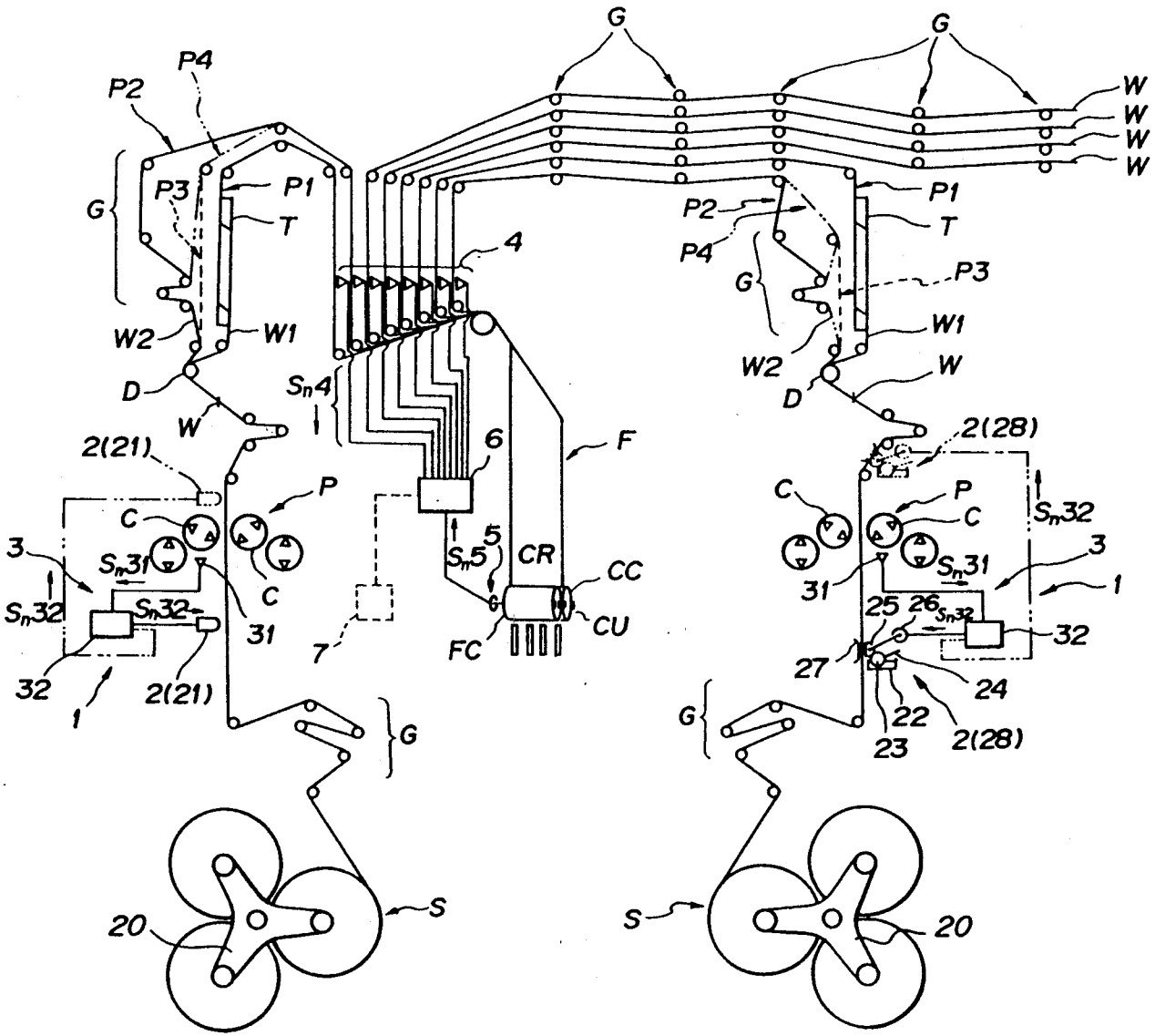
FIG. 1 is a schematic construction diagram of a newspaper press provided with embodiments of the marker for the confirmation of the paper web-threaded paths and the paper web-threaded path confirming apparatus according to the present invention.

The embodiments of the present invention will now be described with reference to the drawing.

FIG. 1 shows a newspaper press as a rotary press provided with a marker used for the confirmation of the paper web-threaded paths and a paper web-threaded path confirming apparatus according to the present invention.

In the newspaper press, paper web feeders S, S . . . are provided with spiders 20. Press units P, P . . . are provided with printing cylinders C, C. A folder unit F is provided with a cutter cylinder consisting of a combination of a cutting cylinder CC and a folding cylinder FC, and a plurality of guide rollers G, G . . . drag rollers D, D . . . and turning bars T, T . . . all of which are provided among the feeders, printers and folder and forming predetermined paper web-threading paths. The paper web feeders, press units and folder unit are arranged in series.

A marker 1, which is used for the confirmation of the paper web-threaded paths according to the present invention, is provided in the vicinity of each of the press units P. This marker 1 consists of a marking unit 2 for putting a mark on a paper web W, and a regulator 3 for making regulations so that the mark put on the paper web by the marking unit 2 has a predetermined phase at all times with respect to a printed image produced during a printing operation.

There are two types of marking units 2, for example, a marking unit 2 of the type employing an ink ejecting nozzle 21 equipped with an electromagnetic cylinder 21*a* for pushing out ink in the ink tank (see FIG. 2), and a marking unit 2 of the type employing a press apparatus 28 consisting of an ink fountain 22, a metering roller 23, a doctor knife 24, a pressure roller 25, a driving unit 26 and an impression member 27.

Two marking units 2, the length of each of which is half as large as that of the printing cylinder C, are provided in the widthwise direction of the paper web W, or a marking unit 2 of a small width is provided in a suitable position in the widthwise direction of the paper web W. The marking unit 2 may be set in a position on the upstream side of the press unit P as shown by solid lines in FIG. 1, or in a position on the down-stream side of the press unit P as shown by two-dot chain lines in the same drawing.

The regulator 3 consists of a timing detector 31 for setting a mark, which is put on the paper web W by the marking unit 2, in a predetermined phase at all times with respect to a printed image produced during a printing operation, and an operation signal transmitter 32 adapted to transmit an operating signal Sn32 to the marking unit 2 when a detected timing signal Sn31 is input from the timing detector 31 thereinto.

Two regulators 3 may be provided for each printing cylinder C so that the regulators 3 are positioned on the left and right sides of the printing cylinder C in the axial direction thereof.

The timing detector 31 shown in FIG. 1 consists of a photoelectric sensor or a proximity sensor, and transmits a detected timing signal Sn31 every time the printing cylinder C is turned 180°. This detector may also be formed so as to detect the rotational displacement of the printing cylinder C by a rotary encoder (not shown) and transmit a signal, or it may be substituted by some other suitable means.

Incidentally, the timing detector 31 is adjusted so as to generate a pulse signal so that printing of the mark is made at the joint portion of the printed image.

Figure 2:
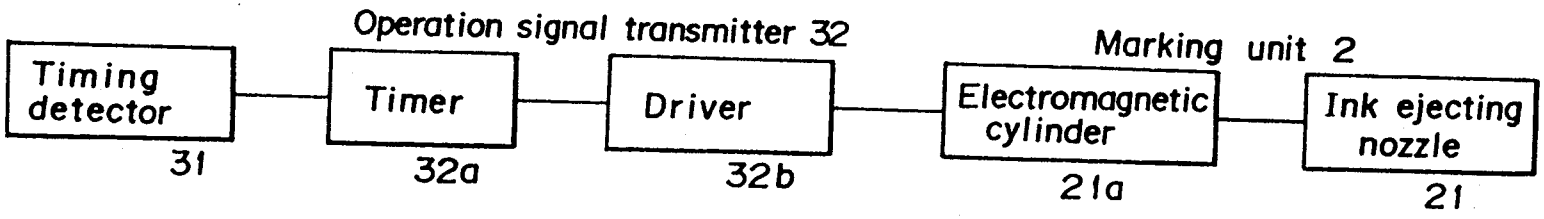
FIG. 2 is a schematic block diagram of a regulator and marking unit in FIG. 1.

An operation signal generator 32 consists of a timer 32*a* and a driver 32*b* as shown in FIG. 2 and the timer 32*a* is connected in such a manner as to receive a pulse signal from the timing detector 31. When the timer 32*a* is a 100 ms-wide timer, for example, it generates a pulse width of 100 ms when a pulse signal from the timing detector 31 is input thereto, and outputs a pulse signal of the 100 ms width.

The driver 32*b* is connected in such a manner as to receive a pulse signal having a predetermined pulse width, such as a 100 ms-wide pulse signal, from the timer, and outputs this pulse signal to the marking unit 2 after power-amplifying the pulse signal.

The paper web-threaded path confirming apparatus according to the present invention is formed by adding various means which are described as follows, and which include a mark detector 4, a rotational phase signal transmitter 5, an examination unit 6 and an alarm 7 which is provided as necessary, to the above-described marker 1 for the confirmation of the paper web-threaded paths.

The mark detector 4 consists, for example, of a reflecting photoelectric sensor, and is provided in the vicinity of an inlet of the folder unit F so as to detect a mark, which is put on the paper web W by the marking unit 2, and transmit a detected mark signal Sn4.

The rotational phase signal transmitter 5 consists of a pulse generator which transmits a pulse signal based on the rotation of one of the pair of cutter cylinders operating cooperatively in the folder unit F or a pulse signal based on the rotation of the folding cylinder FC in the case of the example shown in the drawings. In other words, a zero pulse signal Sn0 is output in synchronism with the rotational phase signal Sn5. The signal Sn0 indicates the time at which the web is cut by the cutting cylinder CC.

The examination unit 6 receives a detected mark signal Sn4 from the mark detector 4 and a rotational phase signal Sn5, which consists of a pulse signal, from the rotational phase signal transmitter 5. The examination unit 6 counts, in the embodiment of FIG. 1, the rotational phase signals (pulse signals) Sn5 while resetting itself every time the folding cylinder FC makes a half turn. The examination unit 6 determines the number of pulses counted at the time of reception of the detected mark signal Sn4, and compares this number of pulses with a predetermined value, which is set and input into the examination unit 6 in advance, whereby the results of the comparison are examined as to whether or not the time of transmission of the detected mark signal Sn4 is within a predetermined permissible range of the rotational phase signal Sn5.

Figure 3:
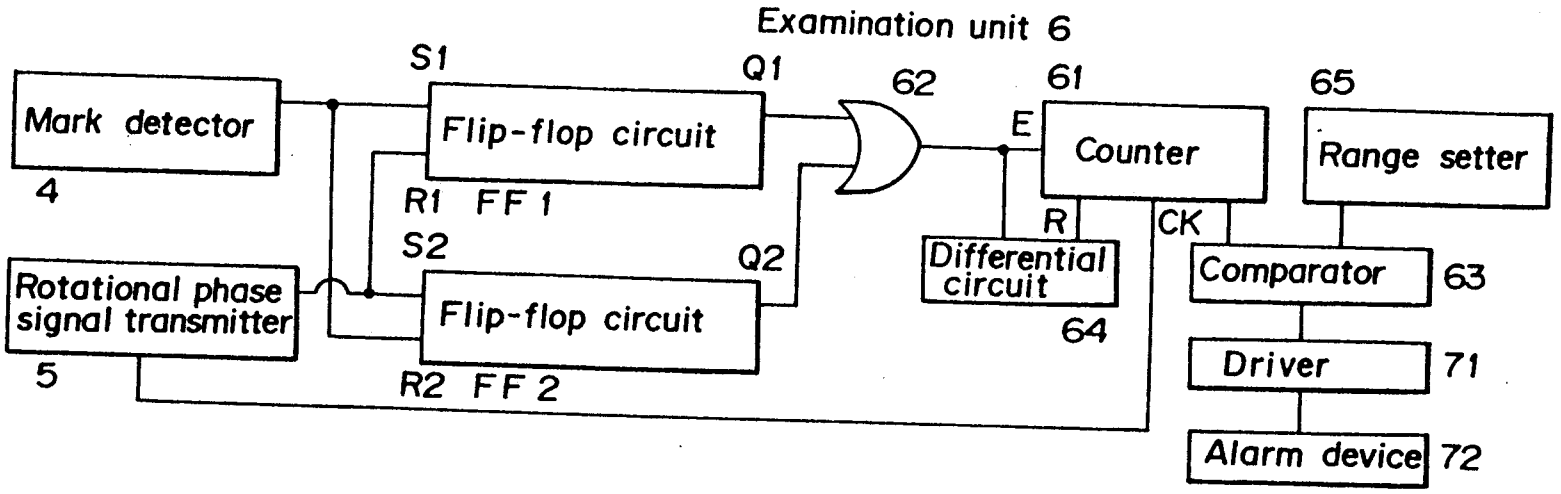
FIG. 3 is a schematic block diagram of a mark detector and examination unit in FIG. 1.

The examination unit 6 is constituted as shown in FIG. 3.

A flip-flop circuit FF1 is connected so that the detected mark signal Sn4 from the mark detector 4 is input to its set S1 terminal and the zero pulse signal Sn0 from the rotational phase signal transmitter is input to its reset R1 terminal. A flip-flop circuit FF2 is connected so that the zero pulse signal Sn0 from the rotational phase signal transmitter is input to its set S2 terminal and the detected mark signal Sn4 from the mark detector 4 is input to its reset R2 terminal. A counter 61 is connected so that the output from the output Q1 terminal of the flip-flop circuit FF1 and the output from the output Q2 terminal of the flip-flop circuit FF2 are input through an OR gate 62 to the ENABLE E terminal. In addition, a reset R terminal of counter 61 receives another output of the OR gate 62 through a differential circuit 64, and the rotational phase signal Sn5 from the rotational phase signal transmitter 5 is input to a counter lock CK terminal of counter 61.

A comparator 63 is connected so that the output of the counted value of the counter 61 and the output of a predetermined value of a range setter 65 are input thereto, respectively. The range setter 65 outputs a predetermined numeric value corresponding to the phase difference between the cutting position and the mark position on the paper web which is set in advance and input to the range setter 65.

Accordingly, the output Q1 terminal of FF1 is kept in an ON state until the detected mark signal Sn4 is input, and the output Q2 terminal of FF2 is kept in an ON state until the zero pulse signal Sn0 is input. These signals are applied to the OR gate and input to the ENABLE E terminal of the counter 61. Furthermore, the signal output by the OR gate is applied to the differential circuit 64 and the counter 61 is reset by a rising pulse output by the differential circuit 64.

The rotational phase signal Sn5, from the rotational phase signal transmitter 5, is applied to the counter lock input CK terminal of counter 61 and subjected to pulse counting.

The pulse counted value, counted by the counter 61, is compared with a predetermined value output from the range setter 65 by the comparator 63 and when the pulse counted value exceeds the predetermined value, a signal from the comparator 63 is output.

The rotational phase signal transmitter 5 may consist, instead of a pulse generator, of a signal transmitter (not shown) which transmits continuous signals while the cutter cylinder is changed from a certain phase to another (corresponding to a predetermined permissible range), so as to examine in the examination unit 6 whether a detected mark signal Sn4 is transmitted during the transmission of predetermined continuous signals.

The alarm 7, which is provided as necessary, is connected so that a signal from the comparator 63, when the results of examination in the examination unit 6 exceeds a predetermined range or in other words, when the number of pulses counted by the counter exceeds a set value output from the range setter 65, is input to the driver 71, and the input signal which is power-amplified by the driver 71 is input to the alarm device 72. The alarm device 72 gives an alarm which is either visual or auditory or both to the operator (see FIG. 3).

The operation and effects of the marker for the confirmation of the paper web-threaded paths and the paper web-threaded path confirming apparatus for newspaper will now be described.

First, a paper web W is supplied from the respective paper feeder S to the folder unit F via a respective press unit P through paper web-threading paths having guide rollers G. Images are printed by the press unit P due to a printing operation thereof. The paper webs W, W . . . printed by the respective press units P, P . . . are then laminated at the inlet of the folder unit F and guided to a position between the cutting cylinder CC and folding cylinder FC. Due to the meshing of a cutting knife CU with a cutting stick CR caused by the rotation of the cutting cylinder CC and folding cylinder FC, the paper webs W, W. . . are cut every time the cutting cylinder CC and folding cylinder FC make a half turn in the embodiment of FIG. 1, and then the cut paper webs are folded and discharged.

In a newspaper press, the printing of 16 pages of newspaper can generally be done by the press units P, P. . . , and the paper webs are threaded through different paths depending upon various conditions, such as the way of allotting 16 pages of paper webs to the press unit P and the width of the paper webs in use.

For example, in order to divide a paper web W into two longitudinally longer pieces (i.e., W1 and W2) at the drag roller D, one divisional paper web W1 is displaced toward the path for the other divisional paper web W2 by the turning bar T in the illustrated embodiment, and these divisional paper webs W1, W2 are threaded through the paths P1, P2 (shown by solid lines). In order not to divide the paper web W into the two longer pieces at the drag roller D, it is threaded through the path P3 (shown by a broken line).

When a control board (not shown) is operated, so that the rotary press receives a command signal for starting a paper web threading operation or starting a paper web-threaded path confirming operation after the completion of the paper web threading operation, the paper web W starts moving through the path, and the marker 1 for the confirmation of the paper web-threaded paths or the paper web-threaded path confirming apparatus starts operating.

In the marker 1 for the confirmation of the web-threaded paths, the timing detector 31 detects marks (not shown) provided at 180° intervals on a suitable portion of the printing cylinder C, and a detected timing signal Sn31 is then transmitted.

The operating signal transmitter 32 receives this detected timing signal Sn31 and transmits an operating signal Sn32 to the marking unit 2. The marking unit 2 receives the operating signal Sn32 and is thereby operated to put a mark on one surface of the paper web W.

The position of installation of the marking unit 2 and the rotational phase of the printing cylinder C are determined correlatively so that a mark put on the paper web W by an operation of the marking unit 2 is always in a predetermined position, for example, an end portion or an intermediate portion of the printed images produced during a printing operation.

A marking operation of the marking unit 2 will now be described. When the marking unit 2 consists of an ink ejecting nozzle 21, a suitable quantity of ink is ejected toward the paper web W.

When the marking unit 2 consists of a press apparatus 28, the driving unit 26 actuates the pressure roller 25 so that the pressure roller 25 makes one revolution. During this time, the ink taken out from the ink fountain 22 by the peripheral surface of the metering roller 23 operatively connected to the pressure roller 25 is regulated to a suitable quantity by the doctor blade 24 and transferred to the pressure roller 25.

A part of the peripheral surface of the pressure roller 25 is chamfered, and a projecting marking portion is provided on this peripheral surface. While the pressure roller 25 is stopped and on standby, the chamfered portion thereof is opposed to the paper web W so that the pressure roller 25 is separated from the paper web W due to the clearance between the impression member 27 and the chamfered portion of the pressure roller 25. While the pressure roller 25 is rotated, the paper web W is held between the impression member 27 and the marking portion of the pressure roller 25, and the ink on the marking portion is transferred to the paper web W to put a mark thereon. The peripheral surface as a whole of the pressure roller 25 may be used as a marking portion thereof.

The impression member 27 may be formed to such a suitable shape that enables the paper web W to be held by the member 27 in cooperation with the pressure roller 25.

The paper web thus marked is transferred to the folder unit F and cut by the simultaneous operations of the cutting cylinder CC and folding cylinder FC as previously mentioned, and it is then folded and discharged.

The discharged paper web W is examined visually as to whether or not the marks put thereon are in a proper position in an end portion of the paper web W or an intermediate portion thereof.

When the paper web W has not been threaded through a predetermined path P1, P2 or P3, for example, when the paper web W2 which should have been threaded through the path P2 was threaded through a wrong path P4 shown by a two-dot chain line in FIG. 1, the relative position of the mark on the cut paper web W with respect to the cutting position deviates necessarily from a proper position since the length of the path extending between the press unit P and the cutting position in which the cutting cylinder CC and folding cylinder FC are operated is different from that of the predetermined path.

The operation of the marker for the confirmation of the paper web-threaded paths which is equipped with the paper web-threaded path confirming apparatus is as follows.

First, the marker 1 for the confirmation of the paper web-threaded paths is operated in the same manner as mentioned above, and a mark is put on the paper web W.

A rotational phase signal Sn5 from the rotational phase signal transmitter 5 is input into the examination unit 6, in which the counting of pulse signals consisting of the rotational phase signals Sn5 is repeatedly done as the examination unit 6 is reset every time the cutting cylinder CC and folding cylinder FC reach a cutting phase, i.e., every time the folding cylinder FC makes a half turn as mentioned previously.

The paper web W, on which marks are put at predetermined intervals, is moved through the paper web-threading path, and the marks reach the mark detector 4, which is provided in the vicinity of the inlet of the folder unit F, and detected thereby, so that a detected mark signal Sn4 is transmitted and input into the examination unit 6. Consequently, the number of pulses counted theretofore is extracted and compared with a predetermined value set and input into the examination unit 6 in advance and including a permissible range, to examine whether or not the transmission time of the detected mark signal Sn4 is within the range of the above-mentioned predetermined numerical values.

This predetermined numerical value is set so that the mark is put on an end portion, i.e. a cut portion of a printed image produced during a printing operation. When the examination unit 6 is formed so that the counting of pulse signals constituting the signals Sn5 of the rotational position of the folding cylinder FX is reset every time the folding cylinder FC reaches a cutting phase, this numerical value is set as follows.

This numerical value is determined by substituting the length of the path, which extends between the position of installation of the mark detector 4 and the position in which the cutting knife CU and cutting stick CR are meshed with each other during a paper web cutting operation, by the number of pulse signals constituting the rotational phase signals Sn5 corresponding to the length of the circumference of the folding cylinder FC. This substituted numerical value is divided by the number of pulse signals constituting the rotational phase signals Sn5 corresponding to a ½ revolution of the folding cylinder FC. The residual in this division is subtracted from the number of the pulse signals corresponding to a ½ revolution of the folding cylinder FC, and then values are determined which have a median consisting of the difference by this subtraction, and which fall within a permissible range of errors.

When the resetting of the counting in the examination unit 6 is done in a phase deviating from the cutting phase of the folding cylinder FC, pulse signals, the number of which corresponds to the deviating phase, are added to or subtracted from the difference obtained in the above-mentioned subtraction, to determine a median. When the mark is put on the intermediate portion of the printed image produced during a printing operation, pulse signals the number of which corresponds to a ¼ revolution of the folding cylinder FC are added to or subtracted from the difference referred to above, to determine a median, and values having this median and falling within a permissible range of errors are determined.

When the time of transmission of the detected mark signal Sn4 exceeds the predetermined range in the above-mentioned examination in the marker and apparatus according to the present invention with a suitable alarm provided therein, an alarm which is both visual and auditory or one of these is given out from the alarm.

When the marker for the confirmation of the paper web-threaded paths and paper web-threaded path confirming apparatus according to the present invention are provided in even a rotary press in which images are not printed during the threading of the paper web, the confirming of the paper web-threaded paths can be done prior to a production printing operation. Accordingly, the quantity of erroneously printed paper webs which might occur during a production printing operation can be reduced to a minimum, and the erroneously threaded paper webs can be threaded through a proper path beforehand. This can prevent a wasteful delay in starting a production printing operation.

The present invention is not, of course, limited to the above embodiments; it may be modified in various ways within the scope of the appended claims.

What is claimed is:

1. A paper web-threaded path confirming apparatus for rotary presses, having printing cylinders which prints on paper webs fed thereto and a folder unit which cuts and folds said paper webs, said folder unit having a cutter cylinder which rotates, said apparatus comprising:

a marker used for confirmation of paper web-threaded paths, said marker includes a marking unit printing marks on a paper web, and a regulator connected to said marking unit, said regulator including a timing detector located adjacent said printing cylinders, said timing detector detecting a rotational phase of said printing cylinders and transmitting a detected timing signal, and an operating signal transmitter, connected to said marking unit and said timing detector, said operating signal transmitter transmitting an operating signal to said marking unit when said operating transmitter receives said detected timing signal from said timing detector, said regulator controlling printing of said marks on said paper web by said marking unit wherein said marks always have a predetermined phase with respect to printed images produced during a printing operation;

a mark detector, located downstream of said marker along said paper web-threaded paths, said mark detector detecting said marks printed on said paper web by said marking unit and transmitting a detected mark signal;

a transmitter located adjacent said folder unit, said transmitter transmitting a rotational phase signal based on a rotational phase of said cutter cylinder rotated in said folder unit; and an examination unit connected to said transmitter and said mark detector, said examination unit determining whether the detected mark signal is within a predetermined range of said rotational phase signal and outputting a signal indicating whether the detected mark signal is within said predetermined range indicating said web-threaded path is correct.

2. An apparatus according to claim 1 further comprising alarm means, connected to said examination unit, for receiving said signal output by said examination unit and for generating an alarm when said signal is not within a predetermined range.

3. An apparatus according to claim 1 wherein said examination unit comprises:

counting means, connected to said mark detector and said transmitter for counting said rotational phase signal input thereto and for outputting a counted value; and comparison means, connected to said counting means, for comparing if said detected mark signal is within a predetermined range of said counted value.

4. An apparatus according to claim 3 wherein said counting means comprises:

first flip-flop means, connected to said mark detector and said transmitter, for outputting a signal when said detected mark signal is received;

second flip-flop means, connected to said mark detector and said transmitter, for outputting a signal when said rotational phase of said cutter cylinder indicates said paper webs are cut;

gate means, connected to said first and second flip-flop means, for gating said signals from said first and second flip-flop means;

differential means, connected to said gate means, for outputting a signal when an output of said gate means rises; and counter means, connected to said transmitter, differential means and gate means, said counter means for counting said rotational phase signals upon input of said detected mark signal.

* * * * *